US005716123A

United States Patent [19]

Lamming

[11] Patent Number: 5,716,123

[45] Date of Patent: Feb. 10, 1998

[54] ELONGATED LIGHT TUBE

[75] Inventor: Michael Lamming, Maryland Heights, Mo.

[73] Assignee: JJI Lighting Group, Inc., Greenwich, Conn.

[21] Appl. No.: 637,235

[22] Filed: Apr. 24, 1996

[51] Int. Cl.[6] ..... F21S 3/00

[52] U.S. Cl. ..... 362/222; 362/223; 362/224; 362/310; 362/307

[58] Field of Search ..... 362/217, 221, 362/223, 224, 222, 267, 310, 374, 375, 307, 308, 329

[56] References Cited

U.S. PATENT DOCUMENTS

| | | | |
|---|---|---|---|
| 2,348,930 | 5/1944 | Schepmoes | 362/224 |
| 2,983,813 | 5/1961 | Pfaff, Jr. | 362/223 |
| 3,833,801 | 9/1974 | Trevithick | 362/222 |
| 4,464,707 | 8/1984 | Forrest | 362/223 |
| 4,573,111 | 2/1986 | Herst et al. | 362/223 |
| 4,667,275 | 5/1987 | Herst et al. | 362/223 |
| 4,858,088 | 8/1989 | Agabekov | 362/223 |

*Primary Examiner*—Thomas M. Sember
*Attorney, Agent, or Firm*—Fitzpatrick, Cella, Harper & Scinto

[57] ABSTRACT

An elongated light fixture is disclosed which includes an elongated hollow transparent tube and a lens panel slidably mounted in the housing to disperse light and/or provide direct light from the fixture. An elongated reflector is mounted in the housing above the lens panel and has one or more light bulbs lighted thereon. The tube has open ends which are closed by caps secured thereto.

27 Claims, 6 Drawing Sheets

ELONGATED LIGHT TUBE

The present invention relates to light fixtures and more specifically to an elongated light fixture in which positioning of a light tube relative to the mounting for the fixture is adjustable through 360°.

Large light fixtures, particularly elongated light fixtures using fluorescent tubing, have been previously proposed for use in a variety of environments. Typically, such fixtures include a housing which is adapted to be mounted on a ceiling or vertical wall so that the light projects directly outward therefrom, with no adjustability. However, in many applications, it is desirable to allow the installer to position the light fixture in a variety of ways to direct light in directions other than horizontally or vertically. To this end, light fixtures have previously been proposed wherein the fixture is formed of an elongated cylindrical tube having a fluorescent lamp or bulb support mounted within it. The tube is closed by end caps to which the lamp support is secured at about the central diameter of the tube with the tube. The tube is mounted to a support surface by circular clamps which permit the position of the tube to be adjusted in the clamps as desired. Such light fixtures have previously been sold under the trademarks RIG-A-LITE and SAMMODE. These fixtures have been generally satisfactory in use, particularly, for example, the SAMMODE fixture, which is adapted for use in wet locations and marine environments. However, in the previously proposed fixtures the elongated light bulbs are open to direct view and still provide light in only one direction.

It is an object of the present invention to provide an elongated light fixture for use in wet, corrosive and marine environments.

Another object of the present invention is to provide an elongated light fixture for use in such environments in which the direction of light dispersion is controlled.

Yet another object of the present invention is to provide an elongated light fixture in which light can be dispersed through 360°.

A further object of the present invention is to provide a light fixture in which light can be directed both horizontally and vertically at the same time.

A still further object of the invention is to provide a light fixture of the type disclosed which has a conveniently accessible interior for changing ballasts and for repairs.

A still further object of the present invention is to provide a light fixture which is relatively simple in construction and economic to manufacture.

In accordance with an aspect of the present invention, a lighting fixture is provided which includes an elongated hollow, generally cylindrical tube. The tube is formed of transparent material and has a pair of opposed open ends. The ends of the tube are closed by circular end caps, which preferably are sealed through neoprene gaskets, or the like, to produce a waterproof, hermetically sealed enclosure. The end caps support a formed reflector panel located within the tube along a diameter thereof to divide the tube into first and second generally semi-cylindrical sections. The reflector panel supports one or more elongated light bulbs, such as fluorescent tubes, on one or both sides thereof.

A generally semi-cylindrical lens support is slidably mounted in the tube on one side of the reflector in one of the semi-cylindrical sections. The lens support has a plurality of ribs formed thereon facing the interior of the tube for engagement with the interior surface to facilitate sliding insertion and removal of the lens support and of interchangeable lens panels from the fixture. This allows the light dispersion pattern of the fixture to be varied by the use of different lens panels or films adapted to be removably positioned in the tube between the lens support ribs as desired. For example, lens panels having light dispersion grooves formed therein may be placed between one or more sets of the support ribs, as desired. Alternatively, no lens panels may be used, or opaque panels may be used to control the direction of light to specified areas. In addition, the opaque sections may be formed to define indicia such as, for example, an exit sign.

The above, and other objects, features and advantages of the invention will be apparent from the following detailed description thereof which is to be read in connection with the accompanying drawings, wherein.

Figure 1:
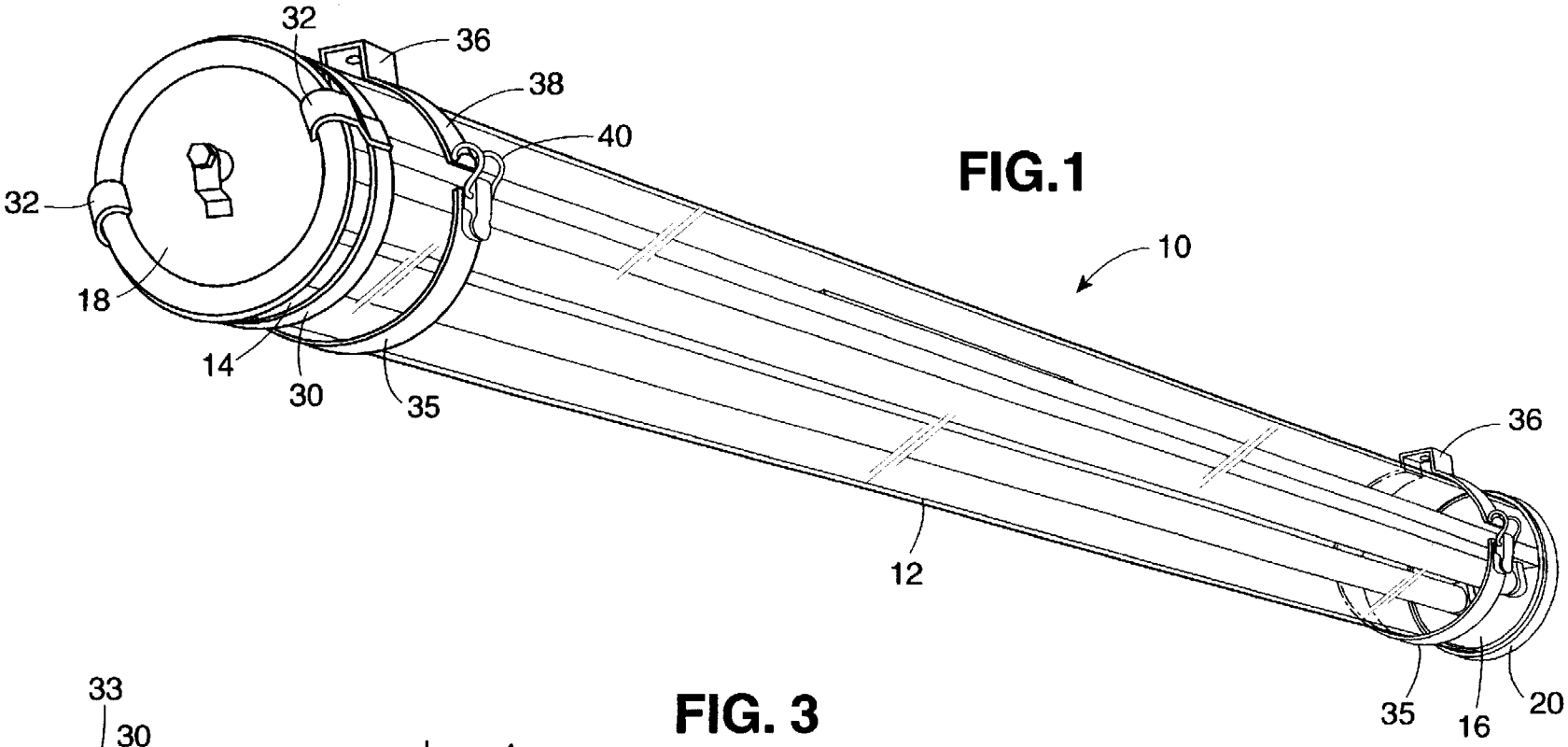
FIG. 1 is a perspective view of a light fixture constructed in accordance with one embodiment of the present invention.
Figure 3:
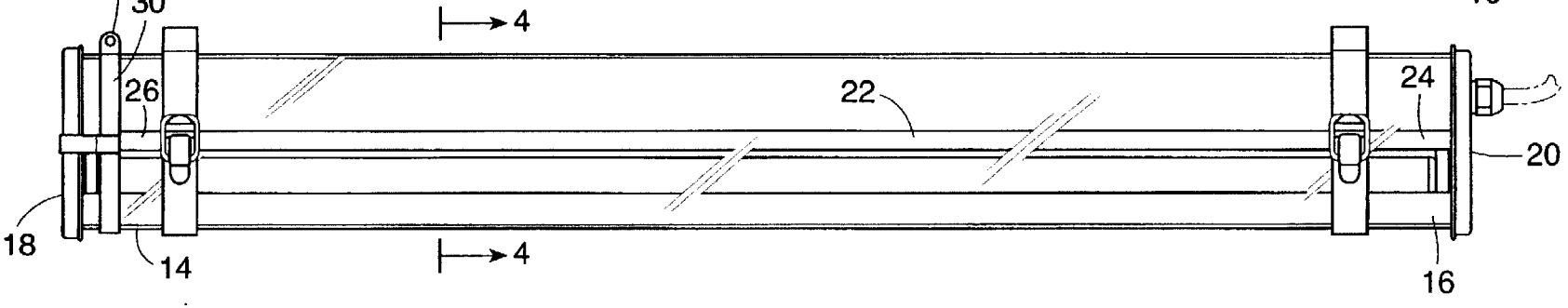
FIG. 3 is a side view of the light fixture shown in FIG. 1.
Figure 2:
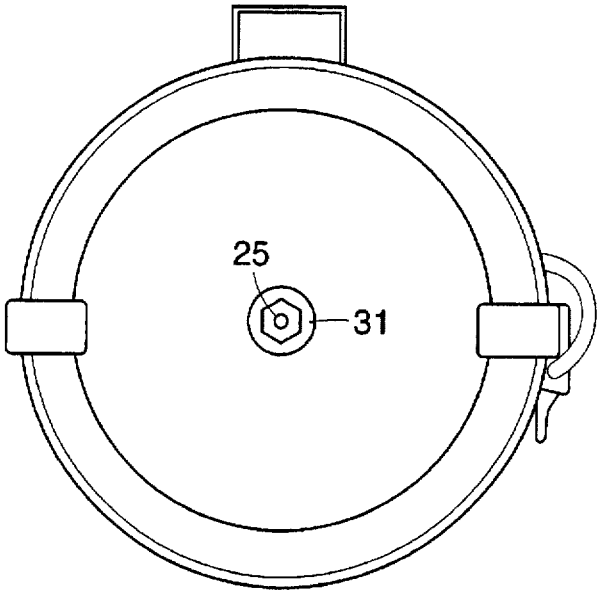
FIG. 2 is an end view of the light fixture shown in FIG. 1.

Referring now to the drawings in detail, and initially to FIGS. 1 and 3, a light fixture 10 is illustrated which is adapted to be adjustably mounted to direct light through 360°. Fixture 10 includes an elongated transparent generally cylindrical tube 12 having open end portions 14, 16. These open end portions are closed by end caps 18, 20, respectively. These end caps are preferably formed of metal and have interior grooves formed therein containing circular neoprene seals 15 (shown in FIG. 5). When the end caps are engaged with the circular edge of the open ends of the tube and secured in place as described hereafter, they form a waterproof seal for the fixture.

A light reflecting panel and lamp support 22 (see FIG. 4) is mounted within cylindrical tube 12, along a diameter of the tube. Panel 22 has free ends 24, 26 which generally align with the ends 16, 14, respectively, of tube 12 when secured in place.

The ends 24, 26 of reflector panel 22 are secured to end caps 18, 20 in any convenient manner. For example, a threaded stud 21 may be riveted or otherwise secured to each end of the panel (see FIG. 5). The threaded end of the stud passes through a central opening 23 in its associated cap. A nut 25 is then threaded onto the stud to clamp the cap and neoprene washer to the ends of tube 12 to hold the cap on the tube and form a waterproof seal therewith. Preferably, an additional sealing washer 31 is used about stud 21 to seal opening 23 as well.

The assembly of end caps and tube is additionally secured in position by a clamping ring 30 having spring fingers 32 integrally formed therewith which clamp around the edge of cap 18. The clamp 30 is drawn down the tube (towards the right as illustrated in FIG. 3) and secured in place by a nut and bolt assembly 33. As a result, the end caps are clamped to the ends of the tube.

This arrangement also facilitates assembly, disassembly and servicing of the fixture since it will hold end cap 18 in place even when its stud 21 is released from the nut so that lamp support 22 can be installed and removed without having to manually hold cap 18 in place while securing cap 20 to its stud.

The construction thus described for securing a reflector panel or lamp support 22 in an elongated tube is a generally known construction and is used in the elongated light fixture sold under the trademark RIG-A-LITE.

Tube 12 is adjustably mounted to be positioned at any angle relative to the mounting surface. To accomplish this, a pair of mounting clamps 35 are provided which surround tube 12. These mounting clamps have bosses 36 formed thereon which are secured to the mounting surface (i.e., the ceiling, wall or pendant mounting down rods) in any convenient manner. The clamps have open ends 38 at which conventional over-the-center fasteners 40 are provided. With the fasteners open, the tube can be positioned within the clamp in any desired position so that light from the bulbs therein is projected in the desired direction. When the tube is properly adjusted in the clamps, the clamps are closed and the tube is fixed in place. Here, again, this clamping and adjusting arrangement is of known construction such as is provided by the SAMMODE fixture.

Figure 4:
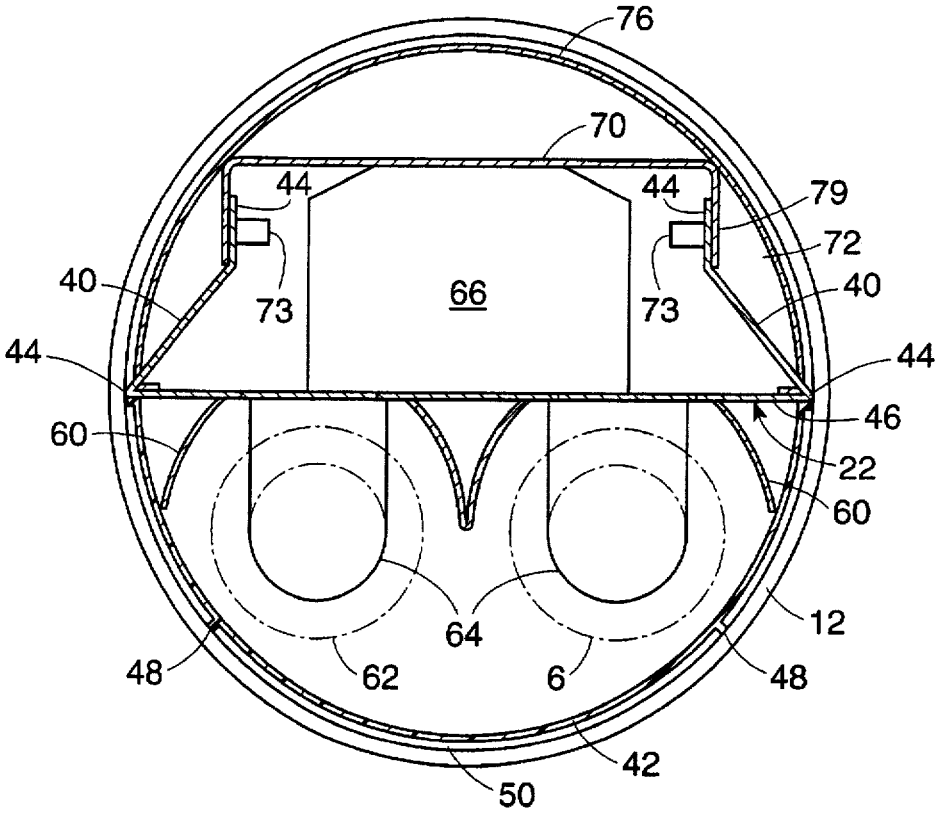
FIG. 4 is a sectional view taken along lines 4—4 of FIG. 3.

The light fixture of the present invention contains a number of important advantages and improvements over the prior art. In accordance with one embodiment of the invention, as seen in FIG. 4, reflector and lamp support panel 22 is a relatively thin metal plate, supported by studs 21 along a diameter of tube 12. Reflector panel 12 has bent side flanges 40 formed thereon.

Figure 8:
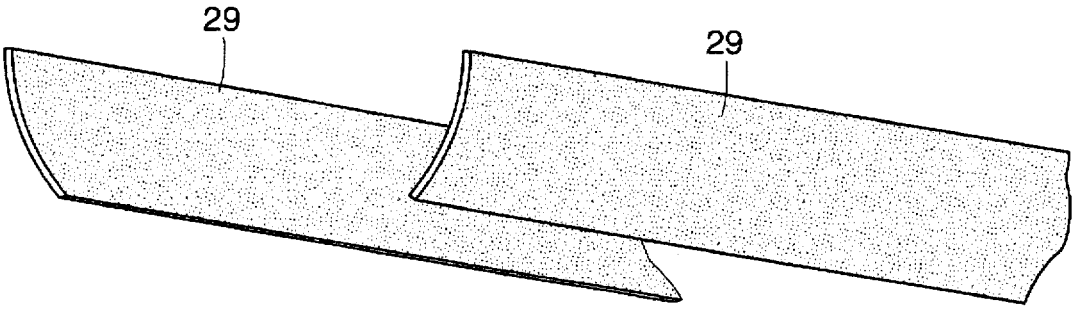
FIGS. 8 and 9 are partial perspective views of two sets of lens panel adapted to be used in the fixtures of FIG. 1 and 5.
Figure 9:
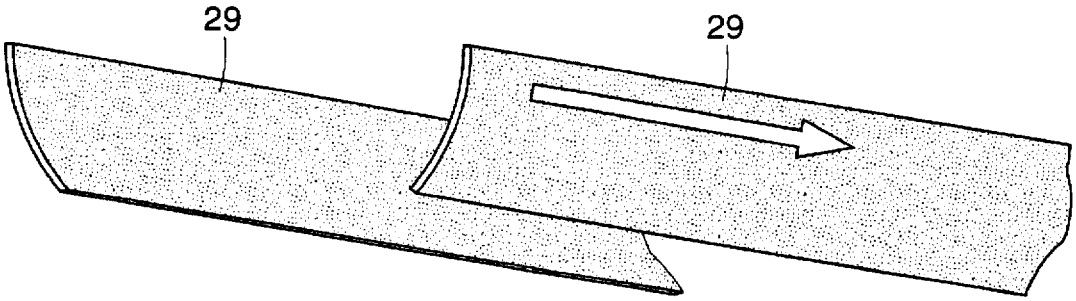

The light fixture of the invention also includes a slide-in lens panel 42 which is adapted to be slid into position beneath reflector panel 22 when end cap 20 is removed from the housing. This slide-in lens panel can be provided in a number of different configurations. As illustrated in FIG. 4, the lens panel is translucent. The panel is semi-circular in configuration and has free edges 44, each of which has an upwardly facing flat surface which faces the lower surface 46 of panel 22. These can serve as a secondary support for the thin reflector panel 22. Indeed, if desired, the entire weight of the reflector panel 22 can be supported on the slide-in lens panel and both supports through the end caps, previously described, can be eliminated. Panel 42 has a plurality of elongated ribs 48 formed on its outer surface to face and engage the inner surface 50 of tube 12. These ribs facilitate the insertion and removal of the lens panel from the tube. They also provide channels in the tube which can receive and support elongated thin film panels 29 (see FIGS. 8 and 12) which may be colored and translucent, or which may be opaque, thereby to allow the user to vary the illumination produced by the lamp. The film panels may include cut-out portions forming indicia, such as the word EXIT or directional arrows, as shown in FIG. 9. The film panels may also be scored to improve light diffusion.

The lens panel 42 in each of the embodiments of this invention is formed of any convenient material, although preferably is formed of acrylic plexiglas which will give the panel sufficient strength to support the reflector. The tube 12 itself is preferably extruded of polycarbonate or acrylic materials.

Figure 11:
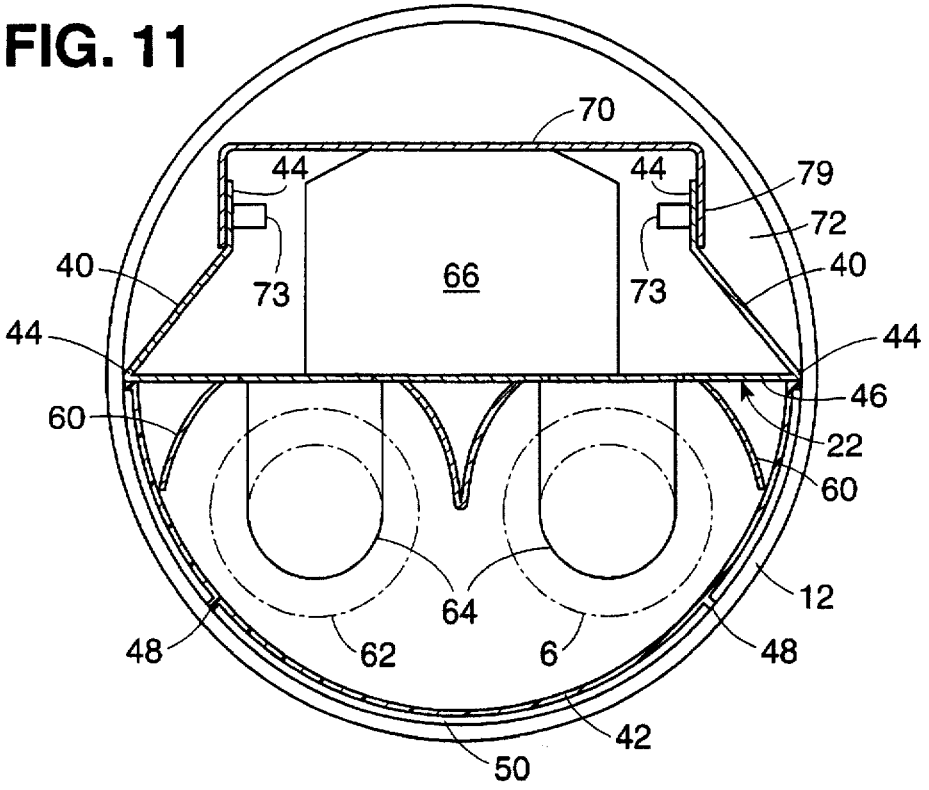
FIG. 11 is a sectional view similar to FIG. 4 of yet another embodiment of the invention.

FIG. 4 also illustrates that the reflector panel 22 may have additional reflector sub-panels 60 mounted thereon in any convenient manner. These sub-panels, as illustrated in FIG. 4, are partially circular in shape, and partially surround the light bulbs 62 mounted in the housing. These reflectors provide for more efficient dispersion of the light and control reflection. They may be eliminated, if desired, as seen in FIG. 11.

The bulbs 62 are mounted on the reflector panel 22 in any convenient manner. Typically, conventional fluorescent end mount connectors 64 are secured on opposite ends of the panel to receive the bulb.

Where elongated fluorescent bulbs are used in the light fixture, a ballast arrangement is normally provided. In the embodiment illustrated in FIG. 4, a standard ballast 66 is mounted on the upper surface 68 of reflector panel 22. In accordance with an aspect of the invention, the ballast is covered by a protective decorative cover 70 to conceal it from view.

Figures 5, 12:
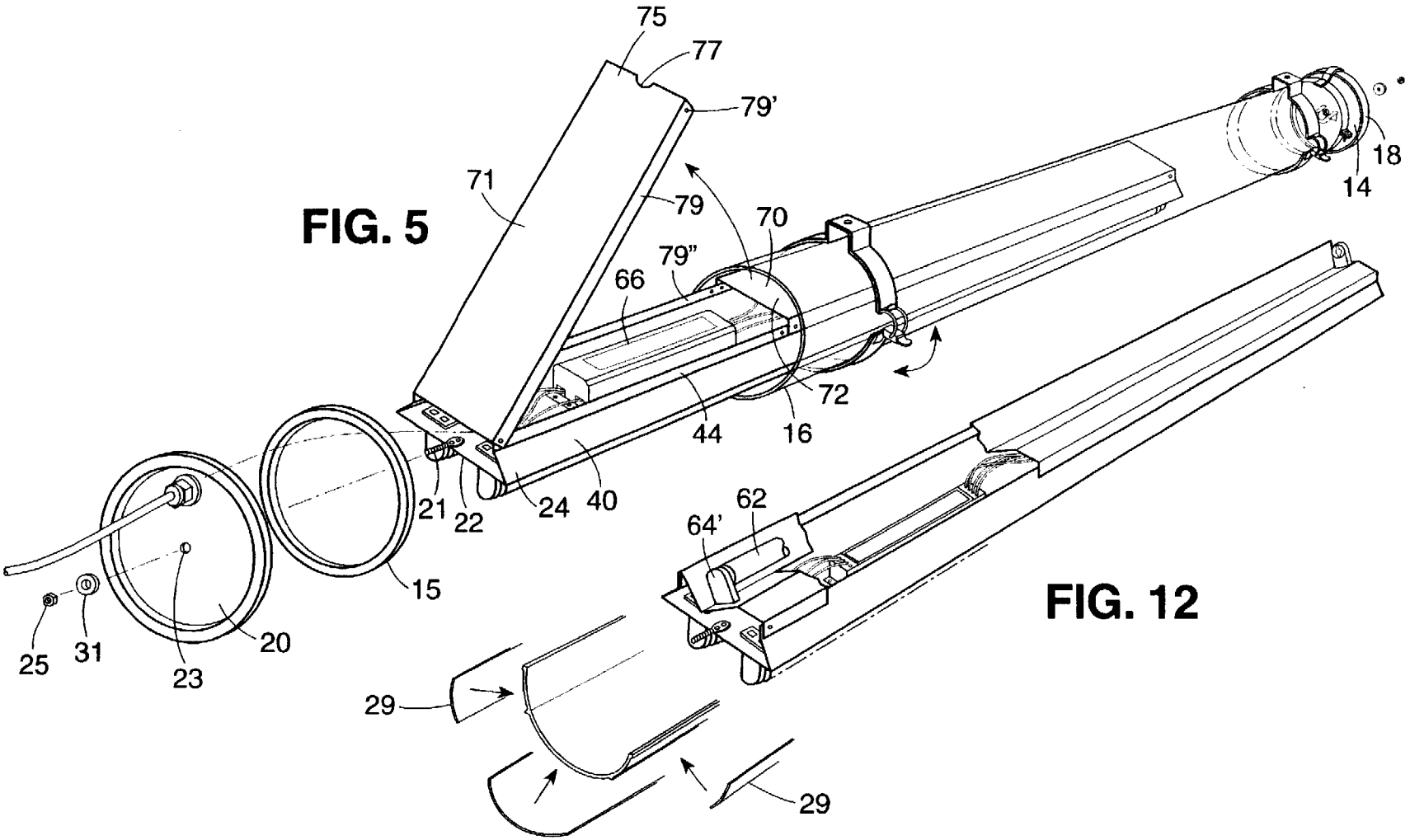
FIG. 5 is an exploded perspective view of another embodiment of the light fixture of FIG. 1 illustrating operation of the access cover of the fixture of the invention.
FIG. 12 is a partial exploded perspective view of the internal lamp support for another embodiment of the invention.
Figure 6:
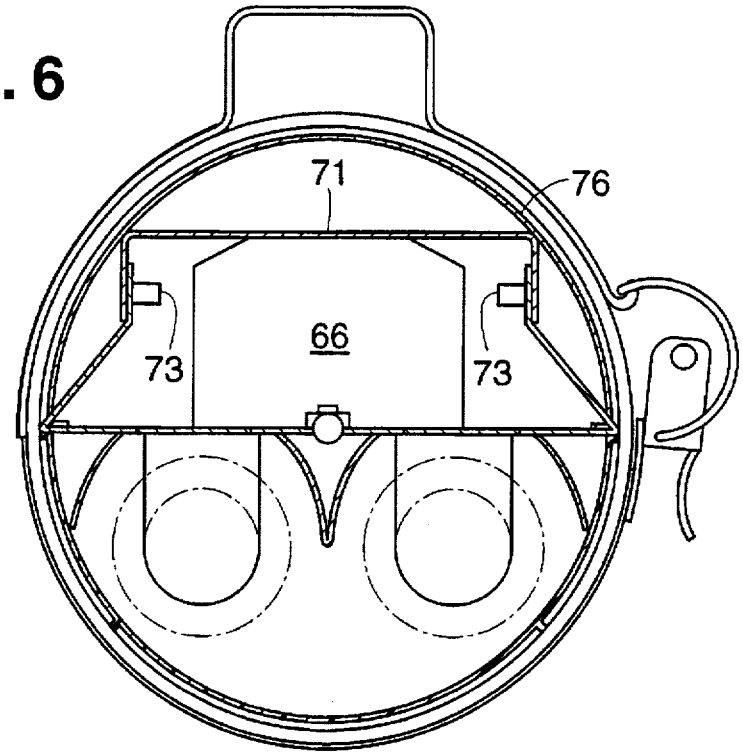
FIG. 6 is an end view of the embodiment of FIG. 5 with the end cap removed.

As shown in FIG. 5, the side flanges 40 of reflector panel 22 are inwardly inclined and terminate in vertical flanges 44. The cover 70 is formed in two sections 71 and 72 which are pivotally mounted on flanges 44. Preferably, ballast 66 is mounted six inches from the end of panel 22 (as seen at the left in FIG. 5) near the supply wire end of the fixture. The cover 71 is sixteen inches long and pivoted to flanges 44 by two rivets 73 which act as pivot pins and which are received through holes formed in flanges 4 (see FIG. 6). The opposite end 75 of cover section 71 has a semicircular hole 77 cut out of its edge to allow a finger to be inserted to pivot the cover up. In addition, the flanges 79 of the cover have protrusions 79' stamped inwardly in them to mate with corresponding indentations 79" on the flanges 44. These cooperating protrusions and indentations provide a positive catch keeping the cover closed. The cover section 72 is also longer than cover 71 and is pivoted at its end 81 to panel 22 in the same way.

This cover and ballast arrangement facilitates easy repair or replacement of the ballast without complete disassembly of the light fixture. To repair the ballast, all that is required is that cap 18 be removed and the nuts on the stud securing cap 20 in place be removed. Then the panel 22 is slid out of tube 12 a distance of only seventeen inches so cover 71 can be pivoted open to expose the ballast. The cover 71 can be completely removed, if desired, simply by squeezing flanges 44 together until the ends of the rivets clear holes in flanges 44. By this arrangement access to the interior of the lamp is provided in minimum space, the covers are easily removed without tools, the covers are easily opened by hand and the full pivoting of the cover over center completely exposes the ballast.

In accordance with yet another aspect of the present invention, a cover 76 may also be provided within the fixture. In the embodiment of the invention illustrated in FIG. 4, the cover 76 can be formed of any desirable material and be opaque, transparent or translucent. The cover is semi-cylindrical in shape and may be secured to panel 22 by tabs inserted in complementing slots formed in the edges of reflector 22.

Cover 76 may be formed of a variety of materials, finishes and colors. This adds an additional decorative element to the fixture as compared to the prior art which has an industrial look. The cover may be eliminated, if desired, as seen in FIG. 11.

Figure 13:
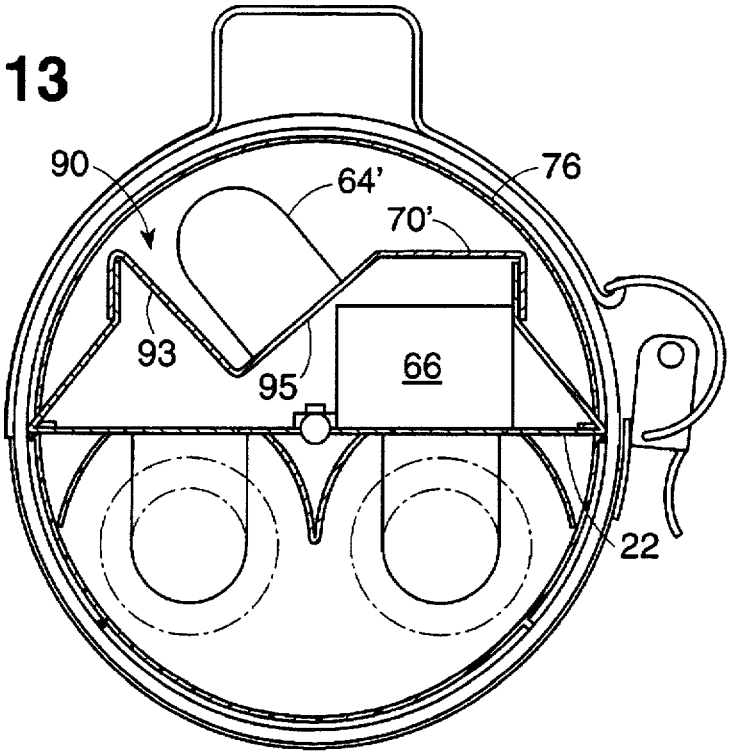
FIG. 13 is an end view of the embodiment of FIG. 12 with the end cap removed.
Figure 7:
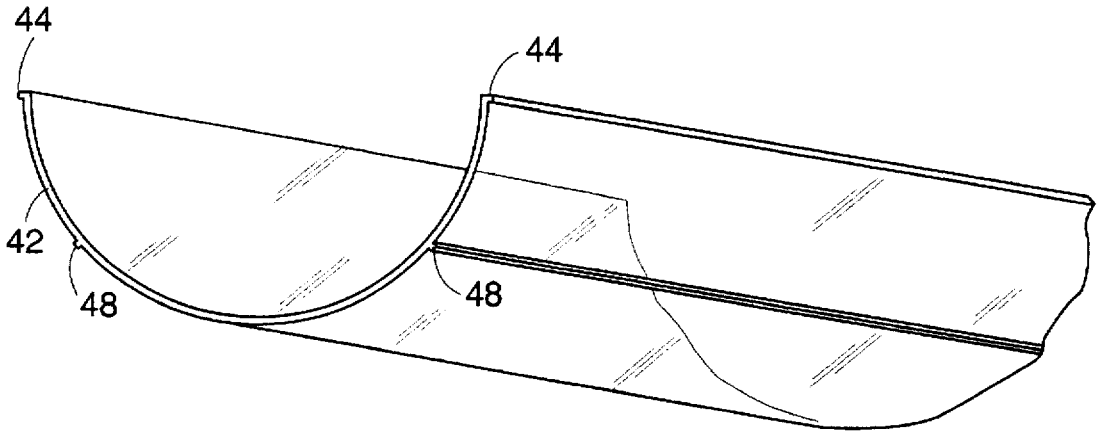
FIG. 7 is an elongated partial perspective view of a semi-cylindrical lens panel support adapted to be used in the light fixtures of FIGS. 1 and 5.

In another embodiment of the invention (seen in FIGS. 12 and 13) an additional bulb 62 may be mounted on the upper surface of a cover 70' on reflector panel 22 to provide upwardly directed light. In this embodiment of the invention, cover 70' has a recess 90 formed therein by two inclined surface sections 93, 95. The cover is constructed to snap onto the flanges 44" of panel 22, as previously described, to allow ease of access to the wireway below the cover containing the ballast 66. Light sockets 64' are mounted on the panel to support bulb 62'. If desired, a transparent semi-cylindrical transparent or semi-translucent cover 76 may be used which can slide in tube 12 over cover 70'.

Figure 10:
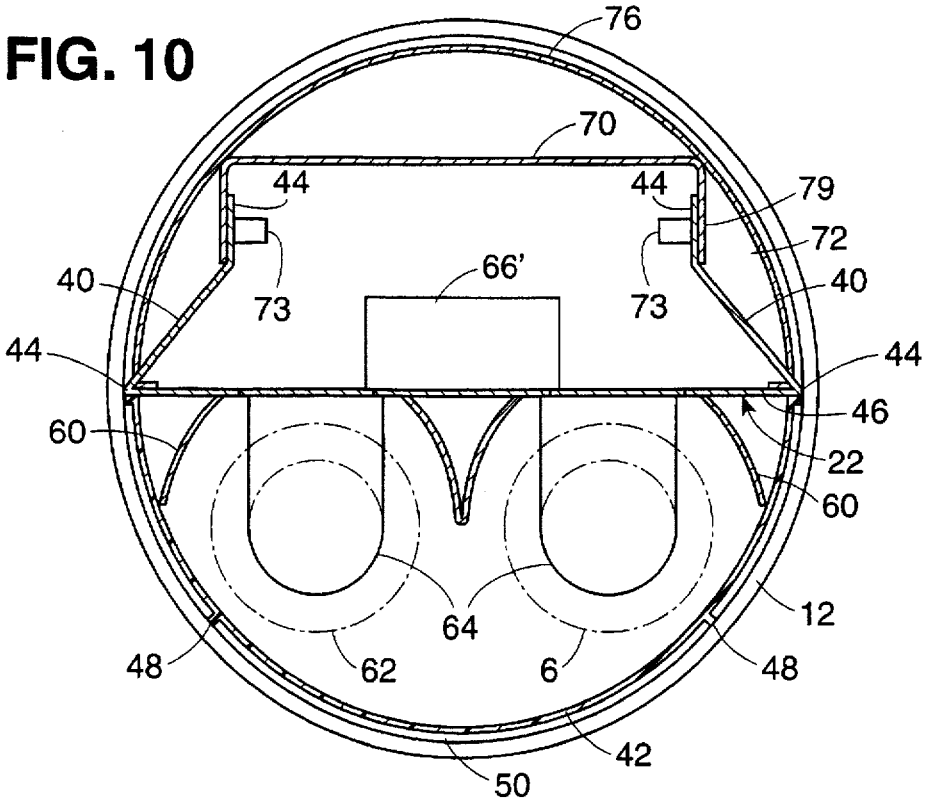
FIG. 10 is a sectional view similar to FIG. 4 of another embodiment of the invention.

As illustrated in FIG. 10, the present invention can be used with a conventional so-called low profile electronic ballast 66'.

The construction of the present invention provides a hermetically sealed fluorescent light tube for use in wet, corrosive and marine environments. The polycarbonate housing 12 and the stainless steel end caps provide total corrosion resistance while the slide-in lens panels described above control light diffusion and provide decorative features as well as potential for signage. The mounting arrangement allows the tube to be adjusted through 360° to direct light in any desired manner or direction.

Although an illustrative embodiment of the invention has been described herein with reference to the accompanying drawings, it is to be understood that the invention is not limited to those precise embodiments, but that various changes and modifications may be effected therein by those skilled in the art without departing from the scope and spirit of this invention.

What is claimed is:

1. A lighting fixture comprising an elongated hollow tube, a lens panel slidably mounted in said hollow tube and having spaced longitudinally extending upwardly facing surfaces, and an elongated reflector in said tube positioned above said upwardly facing surfaces of the lens panel, said reflector including means for supporting at least one elongated light bulb therein.

2. A lighting fixture as defined in claim 1 wherein said lens panel is transparent.

3. A lighting fixture as defined in claim 2 wherein said lens panel has external longitudinally extending ribs formed thereon for supporting it in the tube and allowing the panel to be slidably inserted and removed therefrom.

4. A lighting fixture as defined in claim 3 including at least one lens film slidably positioned between one pair of said ribs and between the lens panel and said tube.

5. A lighting fixture as defined in claim 4 wherein said film is translucent.

6. A lighting fixture as defined in claim 5 wherein said film is colored.

7. A lighting fixture as defined in claim 3 wherein said lens panel has light diffusion grooves formed therein to diffuse light from said bulb.

8. A light fixture as defined in claim 3 wherein said panel includes at least one elongated opaque section in a predetermined section thereof.

9. A light fixture as defined in claim 3 wherein said reflector includes shaped reflector sections forming said panel and partially surrounding at least one said bulb.

10. A light fixture as defined in claim 3 including an elongated opaque cover slidably mounted in said tube above said reflector and supported on said reflector.

11. A lighting fixture as defined in claim 3 including an access cover pivotally mounted on said elongated reflector.

12. A lighting fixture as defined in claim 11 wherein said access cover includes a first pivoted section located adjacent one end of the panel above a ballast supported on the elongated reflector.

13. A lighting fixture as defined in claim 1 including at least one light bulb located on opposite sides of said reflector to provide both up and down lighting.

14. A lighting fixture as defined in claim 13 including a formed reflector cover removably mounted on said elongated reflector having an elongated recess formed therein containing one of said bulbs for directing light upwardly.

15. A lighting fixture comprising an elongated hollow tube, said tube being generally circular in cross-section and formed of a transparent material, an elongated generally flat reflector panel mounted in said tube at about a diameter thereof to divide the tube into first and second generally semi-cylindrical sections, a generally semi-cylindrical lens panel slidably mounted in said tube on one side of the reflector in one of said semi-cylindrical sections; said reflector including means on one side thereof for supporting at least one light bulb thereon within said one section; said lens panel having a plurality of ribs formed thereon facing an interior of the tube for engagement therewith to facilitate sliding insertion and removal therefrom.

16. A lighting fixture as defined in claim 15 wherein said tube has free open ends and said fixture includes end caps removably mounted on ends of the tube to close the tube.

17. A lighting fixture as defined in claim 16 wherein said lens panel is transparent.

18. A lighting fixture as defined in claim 17 wherein said lens panel has light diffusion grooves formed therein to diffuse light from said bulb.

19. A lighting fixture as defined in claim 17 including at least one lens film slidably positioned between one pair of said ribs and between the lens panel and said tube.

20. A lighting fixture as defined in claim 19 wherein said film is translucent.

21. A lighting fixture as defined in claim 20 wherein said film is colored.

22. A light fixture as defined in claim 17 wherein said panel includes at least one elongated opaque section in a predetermined section thereof.

23. A light fixture as defined in claim 17 wherein said reflector includes shaped reflector sections forming said panel and partially surrounding at least one said bulb.

24. A light fixture as defined in claim 17 including an elongated opaque cover slidably mounted in said tube above said reflector and supported on said reflector.

25. A lighting fixture as defined in claim 15 including at least one light bulb located on opposite sides of said reflector to provide both up and down lighting.

26. A lighting fixture as defined in claim 15 including an access cover pivotally mounted on said reflector panel.

27. A lighting fixture as defined in claim 26 wherein said tube has free open ends and said fixture includes end caps removably mounted on ends of the tube to close the tube.

* * * * *